United States Patent [19]

Browning

[11] Patent Number: 4,657,192

[45] Date of Patent: Apr. 14, 1987

[54] PAPER SHREDDER

[76] Inventor: James N. Browning, 1108 Pawnee Dr., Richardson, Tex. 75080

[21] Appl. No.: 616,119

[22] Filed: Jun. 1, 1984

[51] Int. Cl.[4] ..... B02C 18/18

[52] U.S. Cl. ..... 241/224; 241/60; 241/73; 241/242; 241/285 R; 241/294

[58] Field of Search ..... 241/73, 57, 60, 224, 241/238, 241, 242, 243, 294, 260.1, 222, 285 R, 300.1

[56] References Cited

U.S. PATENT DOCUMENTS

| | | | |
|---|---|---|---|
| 1,019,828 | 3/1912 | O'Bryan | 241/242 X |
| 1,699,157 | 1/1929 | Pendleton | 241/242 |
| 2,216,612 | 10/1940 | Dimm et al. | 83/6 |
| 2,224,948 | 12/1940 | Bloomquist | 241/294 X |
| 2,381,775 | 8/1945 | Roddy | 241/241 X |
| 2,873,923 | 2/1959 | Bergman | 241/294 X |
| 3,126,931 | 3/1964 | Blanshine et al. | 241/222 X |
| 3,510,077 | 6/1967 | Priscu | 241/241 |
| 3,790,093 | 2/1974 | McIntyre | 241/73 |
| 3,960,334 | 6/1976 | Wudyka | 241/60 |
| 4,106,708 | 8/1978 | Kropa | 241/242 X |
| 4,363,453 | 12/1982 | Hill et al. | 241/242 X |

FOREIGN PATENT DOCUMENTS

| | | | |
|---|---|---|---|
| 705066 | 3/1954 | United Kingdom | 241/260.1 |

*Primary Examiner*—Mark Rosenbaum

*Attorney, Agent, or Firm*—Glaser, Griggs & Schwartz

[57] ABSTRACT

A paper shredder includes a stator housing on which stator blades are adjustably mounted and a rotor assembly on which rotor blades are securely attached. As the rotor turns within a comminuting chamber, the rotor blades and the stator blades provide a scissors-like cutting action. The stator blades are fixed onto the stator housing with their cutting edges aligned in parallel with the axis of rotation of the rotor assembly. Each rotor blade lies in a plane which is skewed with respect to the axis of rotation, and the cutting edge of each rotor blade is substantially concentric with the axis of rotation. In the preferred embodiment, the rotor and stator blade assemblies are enclosed by three sizing screen quadrant sections. One quadrant section remains open for receiving paper into the comminuting chamber. The paper remains inside the comminuting chamber until it is small enough to pass through the openings of the sizing screen. A suction fan is coupled to the output of the assembly to draw a steady flow of air through the comminuting chamber. Particulated paper entrained within the air flow is drawn through the sizing screens and discharged into a disposal container.

1 Claim, 11 Drawing Figures

PAPER SHREDDER

BACKGROUND OF THE INVENTION

1. Field of the Invention

This invention relates generally to size reduction apparatus, and in particular to a rotary shear for particulating paper.

2. Description of the Prior Art

Rotary shears are known for granulating, shredding, particulating or otherwise reducing the size of diverse materials such as paper, plastic scrap, metal scrap and metal sponge. The purpose of such machines is to reduce the work materials to a predetermined particulate size or fineness. In the disposal of paper materials such as confidential business documents, clasified government documents, and paper currency which has been withdrawn from circulation, it is desirable to reduce the paper materials to a comminuted product having a fine consistency. It will appreciated that high volume disposal operations require a machine which is capable of operating at high RPM levels, and which can reduce a large mass of material quickly and efficiently.

A common problem in the operation of such rotary shear machinery is the maintenance of sharp cutting edges on the rotor and stator blades. Installation and removal of stator blades on most machines is simiplified by the location of the stator blades in accessible locations. The rotor assembly, on the other hand, is relatively inaccessible and must be removed from the stator to provide access to the rotor blades. The rotor assembly removal and installation operations are difficult in most conventional machines because of adjustment of end bearing loading and rotor-stator blade clearance to close tolerances.

Improved rotor assemblies are known in which rotor blades are integrally formed with the rotor shaft. In such rotor assemblies in which the blades are integrally formed either by casting or by machining, it is known to form each rotor blade along a spiral path with respect to the rotor axis. Such rotor assemblies have achieved only limited commercial success because of the fabrication expense and because of the difficulty of sharpening the spiral cutting edges of the rotor blades.

OBJECTS OF THE INVENTION

It is, therefore, an object of the invention to provide an improved cutter assembly in which the rotor assembly can be removed for sharpening, repair or replacement and reinstalled with proper bearing loading and rotor-stator blade clearance.

Another object of the invention is to provide an improved paper shredder in which removable rotor blades and stator blades cooperate to produce a scissors-like cutting action.

SUMMARY OF THE INVENTION

The foregoing objects are achieved by the paper shredder of the present invention which includes a stator housing on which stator blades are adjustably mounted and a rotor assembly having a rotor body on which rotor blades are securely fastened. As the rotor turns within a comminuting chamber, the rotor blades and the stator blades cooperate to provide efficient scissors cutting action. The stator blades are adjustably fixed onto the stator housing with their cutting edges aligned in parallel with the axis of rotation of the rotor assembly. Each rotor blade lies in a plane which is skewed with respect to the axis of rotation, and the cutting edge of each rotor blade is substantially concentric with the axis of rotation.

In the preferred embodiment, the rotor and stator blade assemblies are enclosed by three sizing screen quadrant sections. One quadrant section remains open for loading paper into the comminuting chamber. The paper remains inside the comminuting chamber until it has been cut into pieces small enough to pass through the openings of the sizing screen. A suction fan coupled to the output of the assembly draws a steady flow of air through the comminuting chamber. Particulated paper entrained within the air flow is drawn through the sizing screens and discharged into a disposal container.

In the rotor assembly, a plurality of straight slots are formed in the rotor body and a straight rotor blade is received within each slot. Each rotor blade is securely attached to the rotor shaft by screw fasteners. The rotor body is mounted for rotation on the rotor shaft by tapered end bearings. The stator is assemblied in the form of a cylindrical cage including end blocks and stator bars. The entire rotor assembly is removed axially from the stator through a stator ring end opening. End bearing loading is adjusted by applying tension to the rotor shaft. Rotor/stator blade clearance is set by adjusting the radial position of the stator blades relative to the rotor blades.

The foregoing and other objects, advantages and features of the invention will hereinafter appear, and for purposes of illustrations, but not of limitation, an exemplary embodiment of the invention is shown in the appended drawings.

DESCRIPTION OF THE PREFERRED EMBODIMENT

Figure 1:
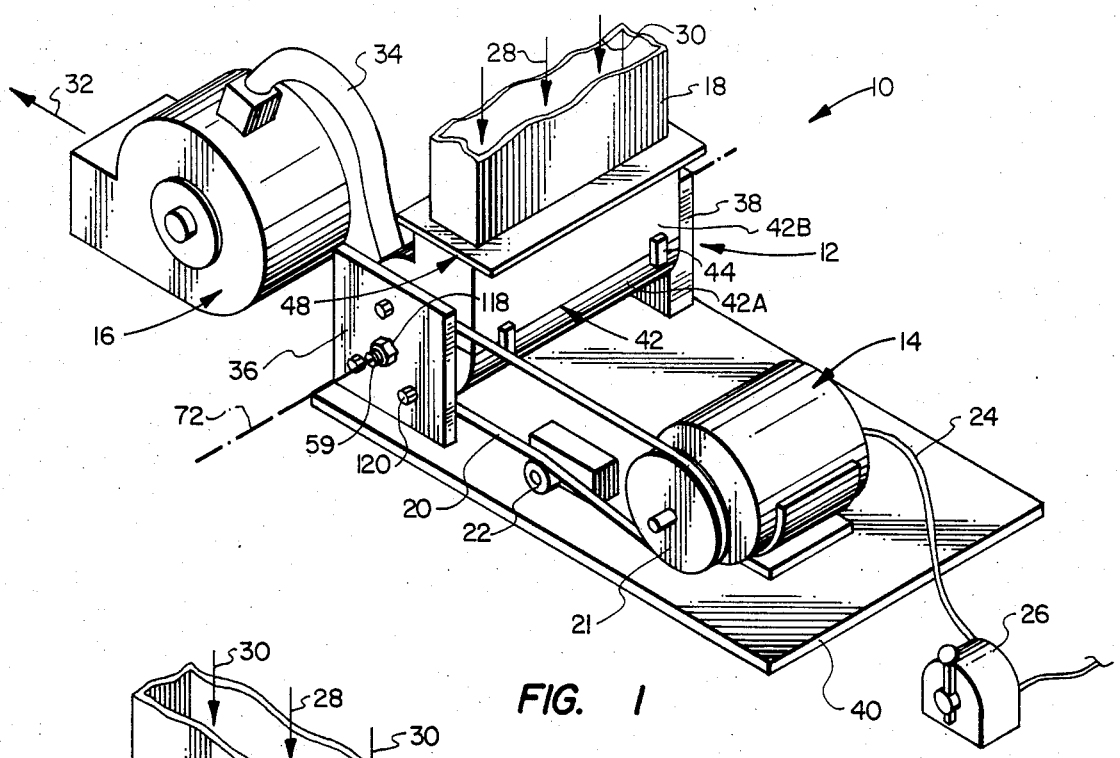
FIG. 1 is a perspective view of a paper shredder constructed according to the teachings of the present invention.

In the description which follows, like parts are marked throughout the specification and drawings with the same reference numerals, respectively. The figures are not necessarily drawn to scale and in some instances proportions have been exaggerated in order to more clearly depict certain features of the invention.

Figure 2:
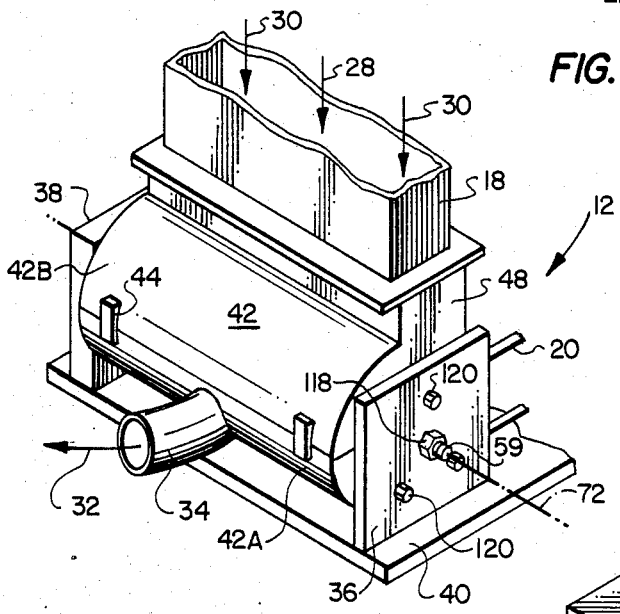
FIG. 2 is a perspective view of a granulator subassembly including shroud and chute portions.
Figure 3A:
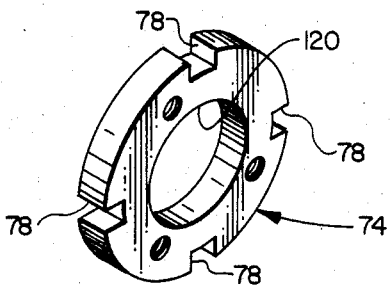
FIG. 3A is a perspective view of a stator ring.
Figure 3:
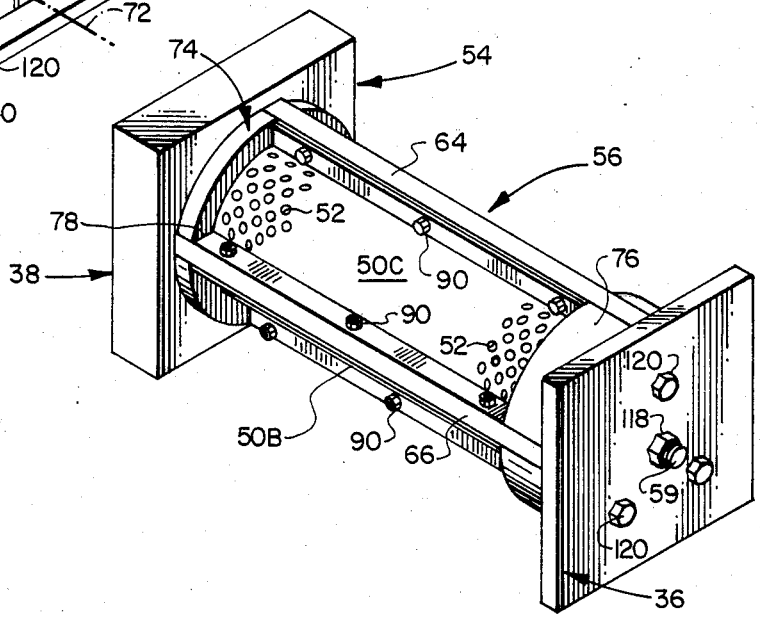
FIG. 3 is a perspective view of the granulator subassembly shown in FIG. 2 with shroud and chute portions removed.
Figure 4:
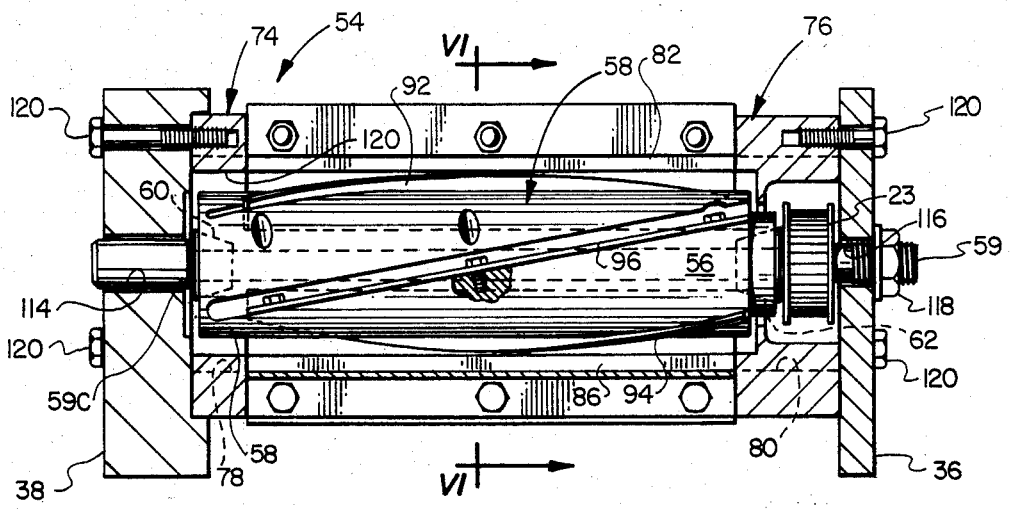
FIG. 4 is an elevation view, partly in section, of the granulator subassembly shown in FIG. 3.

Referring now to FIGS. 1, 2 and 3, a paper shredder assembly 10 includes as its major components a granulator subassembly 12, an electric drive motor 14 and an exhaust blower fan 16. Providing an inlet to the granulator subassembly 12 is a feed chute 18 in the form of a rectangular conduit. The electric drive motor is coupled to the granulator subassembly 12 by a drive belt 20. The drive belt 20 engages a drive pulley 21 on the electric motor 14 (FIG. 1), an idler 22, and a rotor pulley 23 (FIG. 4). Tension in the drive belt 20 is established by the idler pulley 22. The electric motor is energized by electrical power conducted through a power conductor 24. Electrical power is applied and interrupted by a power switch 26 which is connected in series with the power conductor between an external power source (not illustrated) and the electrical drive motor 14.

Paper stock, represented by the arrow 28, is fed into the granulator subassembly 12 through the feed chute 18, and air 30 is drawn through the feed chute 18 and then through the granulator by the blower fan 16. The particulated paper product is entrained within the air flow, thereby forming a moving product stream, represented by the arrow 32. The moving product stream 32 is conveyed from the granulator 12 by an exhaust conduit 34 which couples the blower fan 16 to the exhaust port of the granulator subassembly 12.

In FIGS. 2 and 3, the granulator subassembly 12 is stabilized by stator end blocks 36, 38 which are anchored to a support base 40. The idler pulley 22 and electric drive motor 14 are also securely fastened to the support base 40.

Figure 6:
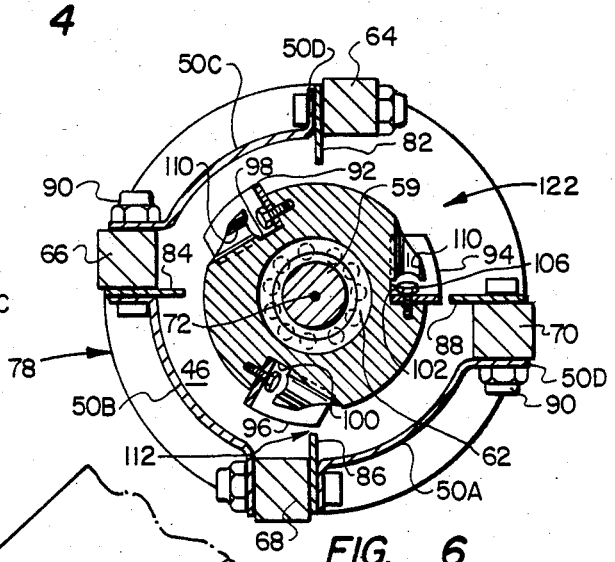
FIG. 6 is a section view taken along the lines VI—VI of FIG. 4.

A sectional housing shroud 42 encloses the rotor and stator blades of the granulator subassembly. The shroud 42 is composed of two separable half casing members 42A, 42B. The upper shroud portion 42B is mounted upon the lower shroud portion 42A and is detachably secured thereto by pivot fasteners 44. The upper shroud 42B is formed with a semi-cylindrical recess which is concentric with the turning path of the rotor blades and forms an upper boundary of a comminuting chamber 46 (FIG. 6). The upper shroud 42B is provided with a feed circuit 48 to which the feed chute 18 is coupled. The lower shroud portion 42A is provided with a semi-cylindrical recess which forms a lower boundary for the comminuting chamber 46. The exhaust conduit 34 is coupled to the comminuting chamber 46 through the shroud sidewall 42A.

In FIG. 3, the housing shroud portions 42A, 42B have been removed with the rotor and stator blades of the granulator subassembly 12 enclosed within sizing screen quadrant sections 50A, 50B and 50C. The sizing screen sections are provided with mesh openings 52 of any desired diameter, preferably ¼ inch for document or currency stock. The curvature of the inner face of each sizing screen is concentric with the cutting circle of the rotor blades as can best be seen in FIG. 6. Each quadrant sizing section partitions the comminuting chamber 46 so that the paper material being cut within the comminuting chamber will be confined within the chamber until it has been cut to the desired particle size to pass through the screen openings for discharge through the exhaust conduit 34.

Referring now to FIGS. 3, 4 and 6, the granulator 12 includes a stator assembly 54 on which a rotor assembly 56 is mounted for rotation. The rotor assembly 56 includes a cylindrical body portion 58 which is mounted for rotation on a bearing shaft 59 at each end by tapered bearing assemblies 60, 62. The tapered end bearings 60, 62 are confined by a press fit of the outer race portion into a bearing seat recess formed within the rotor body 58, and by the engagement of a collar portion 59C of the rotor shaft 59 against the inner race structure.

The stator end blocks 36, 38 are stabilized by stator bars 64, 66, 68 and 70. The stator bars extend axially in parallel with the rotation axis 72 of the rotor assembly 56. The stator bars are equally spaced around the comminuting chamber 46 as can best be seen in FIG. 6. The stator bars are welded at each end to stator rings 74, 76 respectively. The spacing of the stator bars is established by stator ring notches 78, 80 formed at four equally spaced locations around the periphery of each ring, respectively.

Stator blades 82, 84, 86 and 88 are mounted and securely fastened onto the stator bars 64, 66, 68 and 70, respectively. As can best be seen in FIG. 6, each blade is confined between a flange portion 50D of the sizing screen and a stator bar. Slot openings are formed in each stator blade to permit the stator blade to be accurately aligned and positioned within the comminuting chamber 46.

The stator blades are substantially coextensive with the working length of the comminuting chamber 46. Each stator blade is bar-like in form and is securely fastened in place against a stator bar by bolt fasteners 90.

Figure 7:
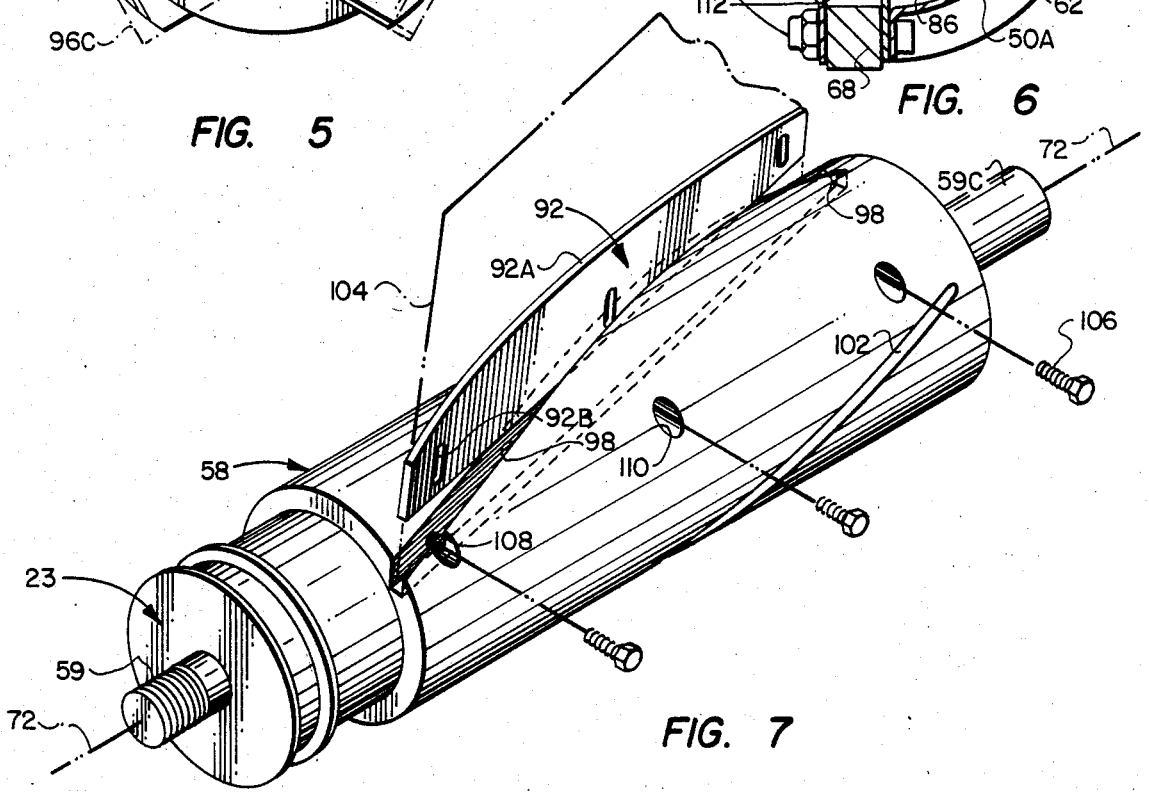
FIG. 7 is a perspective view of a rotor assembly which illustrates the installation of a rotor blade.

According to the preferred embodiment of the invention, the rotor assembly 56 is provided with straight rotor blades 92, 94 and 96. The rotor body 58 is provided with three rotor slots 98, 100 and 102 which are skewed with respect to the rotational axis 72. Referring to FIG. 7, the rotor blade 92 is shown being installed into the straight slot 98. The rotor blade 92 and its cutting edge 92A lie within a plane 104 which is skewed with respect to the rotational axis 72 (FIG. 7). By this arrangement, the rotor blades and stator blades cooperate to produce an efficient, scissors-like cutting action.

Figure 9:
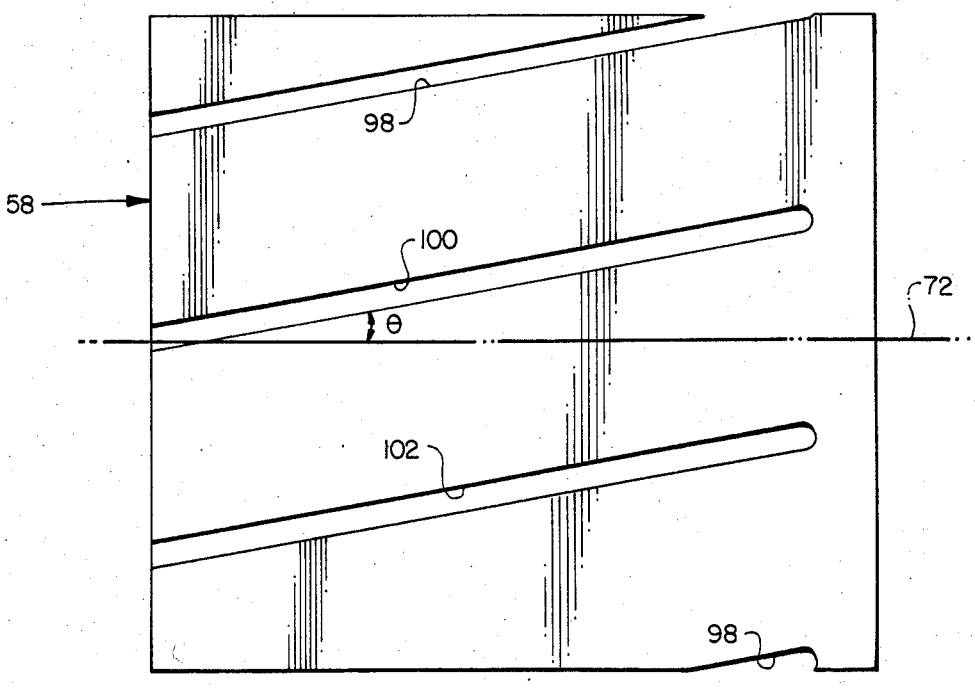

The rotor slots 98, 100 and 102 intersect the external surface of the rotor body 58 and extend downwardly into the rotor body and across the working length of the rotor body as can best be seen in FIGS. 7 and 9. Each slot is skewed at an angle $\theta$, preferably 10°, with respect to the axis of rotation 72. The rotor blade 92 is provided with mounting slots 92B through which bolt fasteners 106 are extended. Threaded holes 108 are formed in the rotor body for receiving the fasteners 106. Access openings 110 are drilled through the rotor body in alignment with each threaded hole 108 to allow passage of the fastener bolts 106 during installation and removal of stator blade 92.

Figure 5:
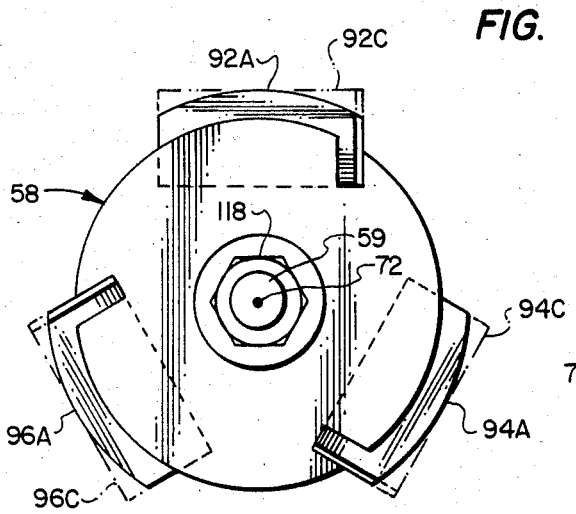
FIG. 5 is a side elevation view of the granulator subassembly shown in FIG. 4.
Figure 8A:
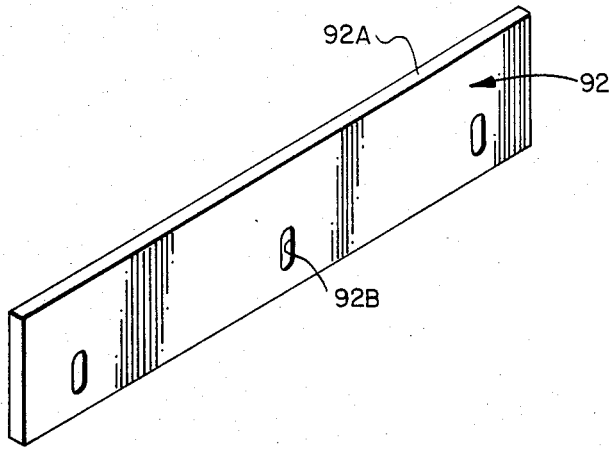
FIG. 8A is a perspective view of a rotor blade before its cutting edge has been machined to be concentric with the axis of rotation of the rotor assembly.
Figure 8B:
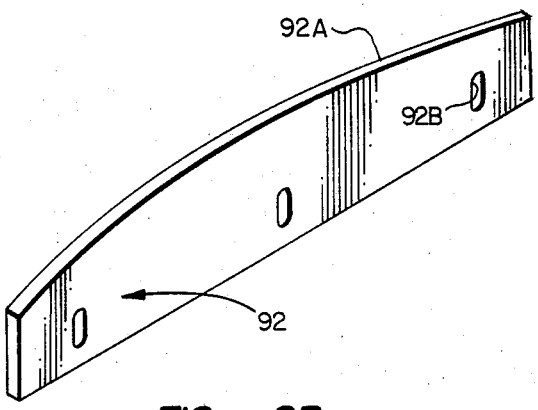
FIG. 8B is a perspective view which illustrates the rotor blade after it has been machined; and, FIG. 9 is a simplified, developed plan view of the rotor body shown in FIG. 7.

Referring now to FIGS. 5, 8A and 8B, the rotor blades initially are in the form of a rectangular bar with a cutting edge 92A and mounting slots 92B. After the three straight rotor blades 92, 94 and 96 have been secured to the rotor body, blade portions 92C, 94C and 96C are ground away on a lathe until the cutting edges 92A, 94A and 96A are substantially concentric with the axis of rotation 72. The blade portions which are removed are indicated by phantom lines in FIG. 5. Before and after views of the rotor blades are illustrated in FIGS. 8A and 8B. After the blade edges have been machined to the approximate curvature, the blades are removed and heat treated for hardness and durability. After heat treatment, the blades are re-installed onto the rotor body and then are ground concentric with the axis 72 within ±0.0005 inches.

The rotor and stator blades are separated by a radial air gap 112 as can best be seen in FIG. 6. The radial clearance provided by the air gap 112 is varied by adjusting the radial projection of each stator blade into the comminuting chamber 46. The air gap clearance 112 is set with the aid of a standard leaf thickness gauge. The actual spacing is determined by the type of material to be comminuted. For paper, air gap spacing 112 of 0.002–0.004 inch is preferred.

The operation of the shredder assembly 10 is as follows: assuming that screen quadrant sections 50A, 50B and 50C of a desired mesh size have been installed onto the stator assembly, and that the appropriate air gap spacing 112 has been established between the rotor and stator blades, electrical power is applied to the drive motor 14 by operating the power switch 26. As the rotor turns, paper material to be cut is then loaded into the feed chute 18 and passes downwardly by gravity flow into the comminuting chamber 46. as the paper material 28 is cut to the desired particle size to pass through the sizing screens, it is drawn through the exhaust conduit 34 by the blower fan 16, with the comminuted paper and air stream 32 being conveyed to a disposal container (not illustrated). The flow of air and comminuted paper through the cutting chamber 46 transfers heat away from the rotor and stator blades.

Although the invention has been described with reference to a specific embodiment, this description is not meant to be construed in a limiting sense. Various modifications of the disclosed embodiment as well as alternative embodiments of the invention will become apparent to those persons skilled in the art. It is therefore contemplated that the appended claims will cover any such modifications or embodiments that fall within the true scope of the invention.

What is claimed is:

1. Apparatus for particulating paper material comprising, in combination:

a shroud assembly partially enclosing a comminuting chamber, said shroud assembly having portions defining an exhaust port, an open quadrant section and a chute coupled to said open quadrant section for loading paper material to be cut into the comminuting chamber;

a stator assembly disposed within said shroud assembly including first and second end blocks, first and second stator rings secured to said end blocks, respectively and a plurality of stator blades mounted on said stator blocks at spaced locations around said chamber, each end of each stator blade being supported by one of said stator rings; and, a rotor assembly received within said comminuting chamber and movably mounted on said end blocks for rotation about an axis, said rotor assembly including a rotor body having a plurality of straight slots and a straight rotor blade receiving within each slot and fastened to said rotor body, each rotor blade having a cutting edge lying in a plane which is skewed with respect to said axis, and the cutting edge of each rotor blade being substantially concentric with said axis.

* * * * *